US005851131A

United States Patent [19]

Bergeron

[11] Patent Number: 5,851,131

[45] Date of Patent: Dec. 22, 1998

[54] SELF-ADJUSTING VARIABLE PITCH PROPELLER

[75] Inventor: Robert M. Bergeron, Alton, N.H.

[73] Assignee: Land and Sea, Inc., North Salem, N.H.

[21] Appl. No.: 876,663

[22] Filed: Jun. 16, 1997

[51] Int. Cl.[6] ..... B63H 3/00

[52] U.S. Cl. ..... 440/50; 416/140

[58] Field of Search ..... 440/50; 416/27, 416/31, 40, 43, 120, 132 R, 140

[56] References Cited

U.S. PATENT DOCUMENTS 5,240,406 8/1993 Speer ..... 416/140

5,494,406 2/1996 Takada et al. ..... 416/134

*Primary Examiner*—Jesus D. Sotelo

*Attorney, Agent, or Firm*—Davis and Bujold

[57] ABSTRACT

A self-adjusting, variable pitch propeller comprising: a central hub defining a propeller rotation axis; a plurality of blade assemblies symmetrically disposed about the hub, each assembly having a substantially cylindrical segment with a propeller blade fast therewith and defining a leading blade edge, each blade assembly being pivotally attached to the hub adjacent the leading edge of the blade of that assembly, a support means interconnecting each assembly and the hub at a location remote from the pivotal attachment to permit controlled blade pitch adjustment to occur as a function of the magnitude of opposed hydrodynamic and centrifugal forces acting on the assemblies by pivotal movement of each assembly, about its the pivotal attachment, both circumferentially and radially relative to the axis.

16 Claims, 3 Drawing Sheets

SELF-ADJUSTING VARIABLE PITCH PROPELLER

FIELD OF THE INVENTION

This invention relates to a self-adjusting variable pitch propeller and more particularly, though not exclusively, to marine propellers.

BACKGROUND OF THE INVENTION

It is known in the art that under conditions when load is high and hull speed is low, a propeller with a low pitch provides for the most efficient translation of engine power to propulsion. However, when higher hull speeds are attained it is known that a propeller with a higher pitch is desirable. Therefore, a propeller which has a variable pitch is advantageous in terms of both performance and extended engine life. Propeller pitch is defined as the axial distance a propeller theoretically travels when making one complete revolution about its axis of rotation. A propeller in its minimum pitch configuration will travel a shorter distance in one revolution than will a propeller configured at a greater pitch.

The most recent prior art relating to a self-adjusting variable pitch propeller relies on the propensity for a blade to rotate about an axis of rotation on a central hub when centrifugal forces acting on the blade, or weighted control arm, exceed the forces on the center of fluid dynamic pressure of the blade and or springs which resists the centrifugal force. Adjustment of blade pitch is accomplished by balancing the centrifugal force acting on the blades against the force on the blades resisting upshift rotation.

To achieve this relationship one design uses an angled slot cam and cam follower pin whereby when centrifugal force acts to move the blade away from the central hub, the blade is rotated about a blade pitch change axis located along the blade's shaft. This rotation about the blade shaft causes the pitch of the blade to increase. Concurrently, force due to the resistance to rotation and/or springs acts on the blade to oppose the pitch increase and to tend to cause its rotation to decrease its pitch accordingly. In such a design this rotation simultaneously moves the blade, by virtue of the angle slot cam, toward the center of the hub in opposition to the tendency to move it away caused by the centrifugal force.

Thus, when the propeller is in motion, two opposing forces are created which act to rotate each blade about its pitch change axis. Therefore, the pitch of the blade is determined by the relative magnitude of the forces applied; one or more of which are derived from the rotation of the propeller assembly. Furthermore, as the speed of the propeller increases centrifugal force increases at a greater rate than the force produced by resistance to rotation. Thus, when the propeller's rotation is slow, the pitch change force produced by resistance to rotation overcomes that produced by centrifugal force. As rotational speed increases, centrifugal force increases faster than the opposing force and eventually exceeds it.

Because the operating conditions under which such devices are subjected are neither stable nor controllable, under certain operating conditions, the center of fluid dynamic pressure on the blade of the prior art design discussed above can, on occasion, move ahead of the blade's pivot point at its semi-centrally located shaft causing the blade to alter pitch unpredictably. This unpredictability of the change in pitch of the blade results in a decrease of the performance of a propulsion system using this prior art. For this reason, there is a need for an improved self-adjusting, variable pitch propeller.

SUMMARY OF THE INVENTION

It is an object of the present invention to provide an improved means for automatically adjusting the pitch of a propeller blade without the use of drag inducing blade attaching shanks and clearances between the base of the blade and the hub.

It is further an object of the present invention to provide a more stable propulsion system by providing a means for maintaining a consistent blade pitch at a consistent load throughout a variety of turbulent flow conditions by assuring that the center of fluid dynamic pressure on the blade is always aft of the blade's pitch adjustment pivot point.

The self-adjusting variable pitch propeller of the present invention provides an improved means for automatically adjusting the pitch of a propeller blade as well as a means for maintaining the blade pitch throughout a variety of turbulent flow conditions by assuring that the center of pressure of the blade is always aft of the blade's adjustment pivot point.

According to the invention there is provided a self-adjusting variable pitch propeller having a support means defining a propeller rotation axis and a blade assembly supported by said support means for rotation thereby about said axis, said assembly comprising; a) a blade; b) a pivotal means pivotally securing said blade to said support means; and c) a control means connecting said blade to said support means, said control means being spaced from said pivot means for adjustably controlling the pitch of said blade at least in part as a function of opposed hydrodynamic and centrifugal forces acting on the blade.

Also provided is a self adjusting, variable pitch propeller comprising a central hub defining a propeller rotation axis, a plurality of blade assemblies disposed about said hub, each assembly having a substantially cylindrical segment, said cylindrical segment having a leading and a trailing edge and a propeller blade fast to said cylindrical segment defining a leading blade edge, a pivotal attachment pivotally securing each blade assembly to said hub, and control means interconnecting each assembly and said hub to permit controlled blade pitch adjustment to automatically occur by allowing circumferential and radial movement of said assemblies relative to said axis, as a function of the magnitude of at least the opposed hydrodynamic and centrifugal forces acting on the assemblies.

Preferably:

a) in a normal direction of rotation about said axis, said pivotal attachment circumferentially leads the leading blade edge of the associated blade at the junction of the blade with the cylindrical segment;

b) the propeller is automatically adjustable from a minimum to a maximum pitch and when at maximum pitch the cylindrical segments together form a substantially complete cylinder about the said axis;

c) each pivotal attachment is a ball joint defining a pivot center adjacent the associated segment;

d) the support means for each assembly comprises two parallel and equal length arms, namely a first arm pivotally attached to the cylindrical segment of that assembly adjacent its trailing edge and a second arm pivotally attached to the cylindrical segment of that assembly toward the leading edge of that assembly;

e) there are three blade assemblies and their respective arms are pivotally attached to the hub at two adjacent of three pivots having axes extending parallel to the rotation axis and evenly spaced about the hub at the same radius from the rotation axis;

f) the three pivot axes are circumferentially adjacent the leading edges of each assembly and extend close to the radial axes of the ball joints;

g) the first and second arms of adjacent assemblies are in each case, pivotally mounted to the same pivots on the hub;

h) all pivotal mountings of the arms are ball joints;

i) when the centrifugal force exceeds the opposing hydrodynamic force and/or any spring force the arms of each assembly pivot toward an orientation tending to radially retract the first arms radially and extend the second arms from the rotational axis in which situation the cylindrical segments, under control of the arms, define a substantially complete cylinder supporting the blades desirable for high speed operation;

j) the movements of the blade assemblies are constrained by synchronizing arms, which are pivotally secured to a stabilizing ring which is freely rotatable on the hub about the rotational axis to coordinate the simultaneous movement of the cylindrical segments between their cylindrical, maximum pitch position and their minimum pitch position; and/or k) a biasing spring, attaching the stabilizing ring and the central hub, biases the blade assembly in favor of its minimum pitch position until the blades are subjected to a centrifugal force great enough to overcome the spring tension and the hydrodynamic force.

It should be noted that while in d) the arms, which are parallel and of equal length define a parallelogram which shifts, as the centrifugal force exceeds the hydrodynamic force and/or any spring force, causing the movement of the cylindrical segments, however it is also possible for such support arms to be of unequal length and non-parallel therefore defining an irregular polygon which would impart a specified movement of the cylindrical segment.

BRIEF DESCRIPTION OF THE DRAWINGS

The invention will now be described, by way of example, with reference to the accompanying drawings, in which.

Description of the Preferred Embodiments

Figure 1:
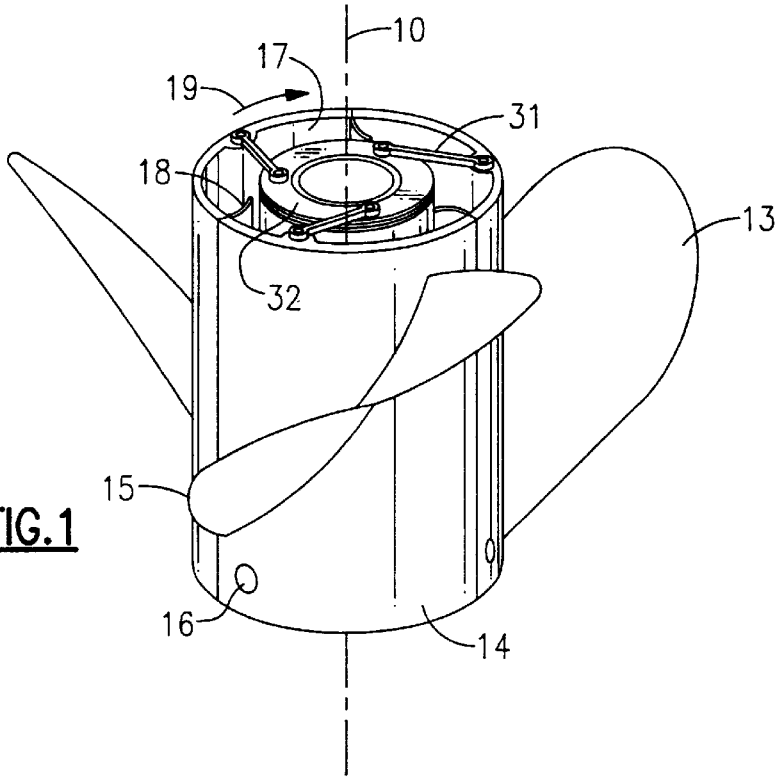
FIG. 1 is a diagrammatic view of variable pitch marine propeller according to the present invention shown in its maximum pitch position.

Referring to FIGS. 1 to 4, the arrangement therein shows the propeller assembly in its maximum pitch position. Three equally spaced, and balanced blades (13) are secured to part cylindrical segments (14) forming three identical blade assemblies. The blade assemblies are each pivotable about a pivot (16) located adjacent the cylindrical segments (14) close to the leading edges (15) of the blades. These pivots (16) pivotally connect the blade assemblies to the central hub (11). Surrounding the central hub (11) is an exhaust port (17), divided into three parts, running longitudinally between the central hub (11) and the blade assemblies, parallel to the axis of rotation (10). This exhaust port (17) is capable of venting exhaust gases from an attached motor (not shown) to an exterior environment. The exhaust port (17) is partially divided by vanes (18) attached to the cylindrical segments (14) which tend to prevent exhaust gases from escaping and interfering with the flow around the blades (13) primarily in low pitch conditions. The components of the propeller assembly embodiment herein described are fashioned from materials which are substantially resistant to rust and corrosion in marine environments, for example, stainless steel.

Figure 2:
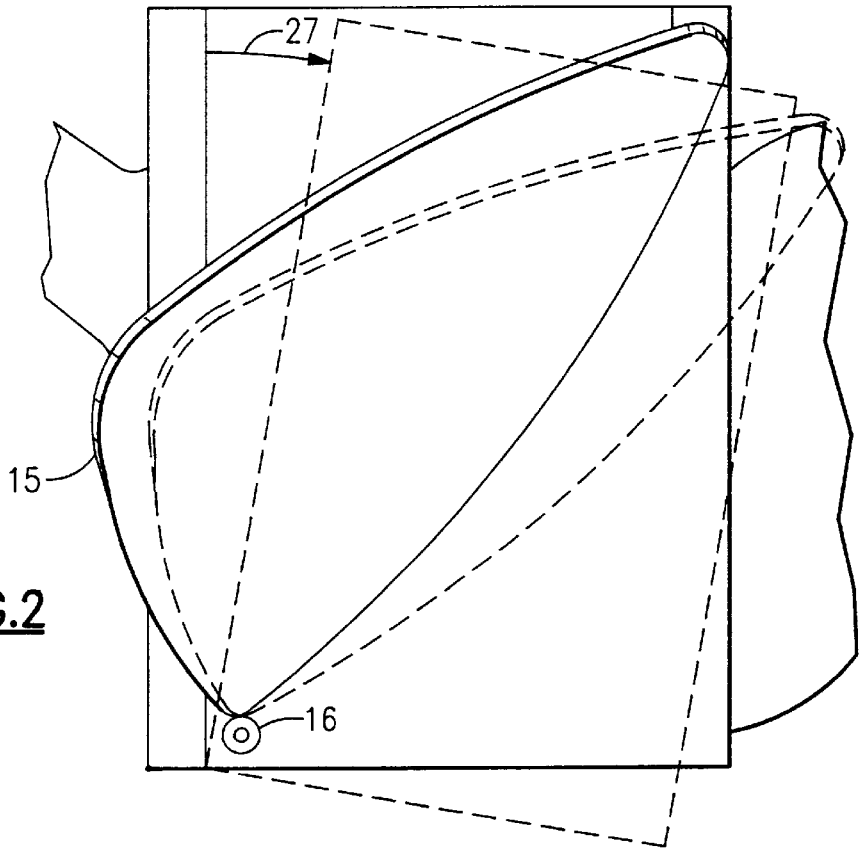
FIG. 2 is a side view emphasizing one blade assembly, shown in FIG. 1, pivoting about its pivot point from its maximum to its minimum pitch position.

Together, the cylindrical segments (14) of the blade assemblies form a cylinder when the propeller assembly is in the maximum pitch position, as shown in FIG. 1. Rotation of a splined drive shaft secured in the splined bore (12) causes rotation of the central hub (11) with its connected blade assemblies about the axis of rotation (10) in the direction shown by arrow (19) when the propeller is operated in its normal direction of operation. Centrifugal forces resulting from rotation of the propeller act on the blade assemblies at their center of mass, causing the blade assemblies to pivot about their pivot points (16) and move outward away from the central hub (11). FIG. 2 more clearly illustrates the pivotal movement of the blade assembly about pivot (16) from a maximum pitch position to a minimum pitch position. As previously mentioned, pivot (16) is a ball joint and therefore allows for rotational freedom about three mutually perpendicular axes positioned adjacent to both the leading edge (15) of the propeller blade and the leading edge (30) of the cylindrical segment (14). As shown, the blade assembly pivots between its dashed, minimum pitch position and its solid, maximum pitch position about the pivot (16). The range of pitch adjustment may, for example, be from 11 to 22 inches.

Pivotal movement of each blade assembly about its pivot (16) between minimum pitch and maximum pitch is controlled by two arms (20, 21), namely a first arm (20) pivotally attached, at a first outer pivot (24), to the cylindrical segment (14) of that assembly adjacent its trailing edge (29) and a second arm (21) pivotally attached, at a second outer pivot (23), to the cylindrical segment (14) of that assembly toward the leading edge (30) thereof behind in the direction of rotation (19), the pivot (16) of that assembly. The arms (20, 21) are pivotally attached to the hub (11) at two adjacent of three axes (22) extending parallel to axis (10) and evenly spaced about the hub (11) at the same radius from axis (10). The arms (20, 21) of all blade assemblies are spaced axially of the propeller by a distance from the pivots (16) to provide adequate control of the assemblies pivotal movement about pivots (16).

It will be noted that axes (22) are circumferentially adjacent the leading edges (30) and extend close to the radial axes of pivots (16).

Figure 5:
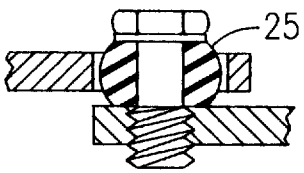
FIG. 5 is a fragmentary cross-sectional view taken through a spherical rod end (ball joint) typical of all linkages and pivot points of the propeller of FIG. 1.

The pivotal mounting of the first arm (20) of an assembly and the second arm (21) of the next leading, in the direction of rotation (19), assembly are, in each case, pivotally mounted to the same axis (22) with the pivots (24) on these axes (22) being disposed as reasonably close together axially as the physical structure permits. All pivots (22, 23 and 24) are ball joints (25) as diagrammatically illustrated in FIGS. 5 and 6, the design of which is well known to those skilled in the art.

Figure 3:
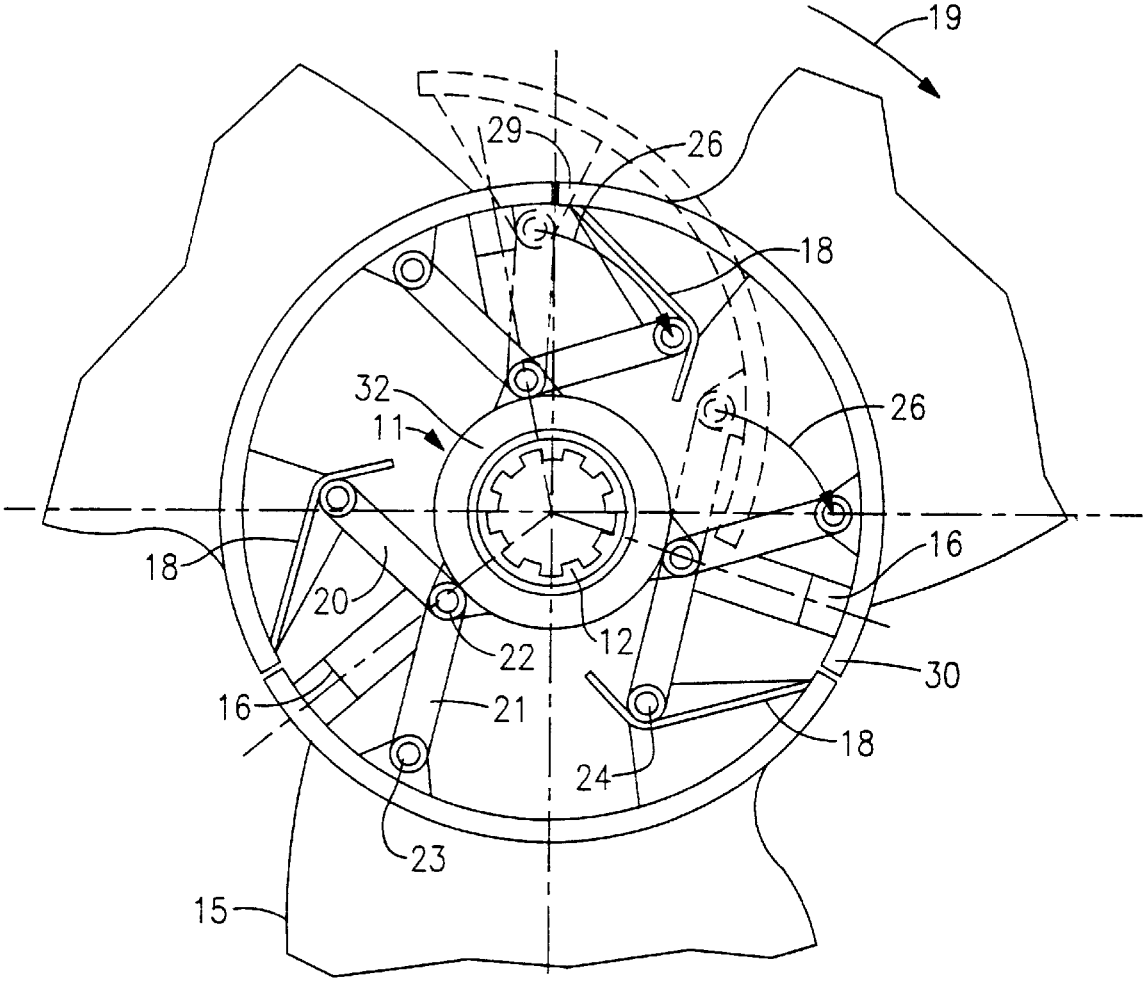
FIG. 3 is a view of the support linkages attaching the hub to the cylindrical segments of three blade assemblies, with solid lines demonstrating the maximum pitch position of the three assemblies and the segmented line view of one assembly oriented at its minimum pitch position.

During a change in blade pitch the changing balance of hydrodynamic force on the blade acting through its center of pressure (33) and centrifugal force on the blade assemblies moves the assemblies and arms (20, 21) between the positions shown dashed in FIGS. 2 and 3 and the solid line position of the same figures. Although the arms move synchronously, the dashed position, shown for one blade only, occurs when the hydrodynamic and/or any spring force is greater than the opposing centrifugal force, as during boat start-up. In this minimum pitch, dashed position, the trailing edge (29) is positioned at a greater radius from axis (10) than does the leading edge (30). The assemblies then gradually move to the solid position as the centrifugal force balances and then exceeds the opposing hydrodynamic force, thereby moving the first arms (20) toward an orientation tending to be radially retracted and the second arms (21) toward an orientation tending to be radially extending from axis (10) in which situation the cylindrical segments (14) under control of arms (20, 21), define a substantially complete cylinder supporting the blades (13), as is desirable for high speed operation. Movement of the arms (20, 21) from the dashed to the solid positions is shown by arrows (26) in FIG. 3 and pivotal movement about pivot (16) of an assembly toward its minimum (dashed in FIG. 2) pitch position is shown by arrows (27) in FIGS. 2 and 4. Arrow (26) in FIG. 3 shows the direction of movement toward an substantially cylindrical surface under the effect of centrifugal force.

It will be appreciated that although axes (22) are shown as common pivot axes for two arms (20, 21) each, these axes could be separated into two parallel axes each, with each associated with the pivotal mounting of one arm (20 or 21) to the hub (11).

The arm configuration utilizes identical length arms (20, 21), their relative locations with respect to the blade assembly pivot (16), and their connecting integrated ball joints (23) and (24) acting to direct the movement of the blade assemblies as they pivot about their pivot points (16); thereby effecting a change in pitch of the blade assemblies. The assembly has a leading edge (30) in the direction of normal rotation of the propeller with the arm (21) being attached nearest to the leading edge (30), and the arm 20 being attached closer to the trailing edge. The arm (21) is attached to the trailing edge of the assembly in such a manner as to permit the trailing edge to rotate to a greater radial distance from the axis then the leading edge.

The arms (20, 21) of each blade assembly form parallel straight lines joining their respective pivotal supports at the hub and the assembly, the two arms and straight lines joining respective pivotal supports together defining a parallelogram.

The outer pivots (24) of the first arms (20) are radially closer to axis (10) than the outer pivots (23) of the second arms (21).

Figure 6:
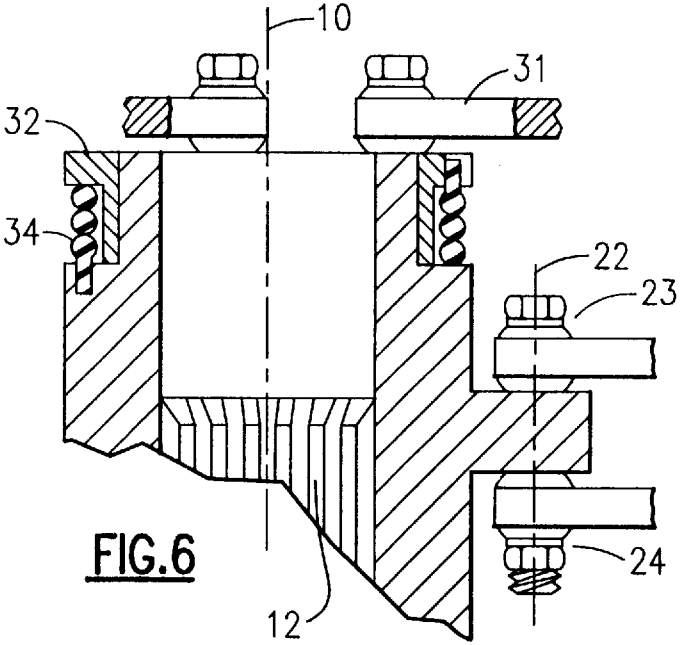
FIG. 6 is a fragmentary cross-sectional view of a propeller blade synchronizer, of the propeller of FIG. 1, taken through its centerline showing the connection of the stabilizer pivot arms to the stabilizer ring and their relationship to a biasing spring.
Figure 4:
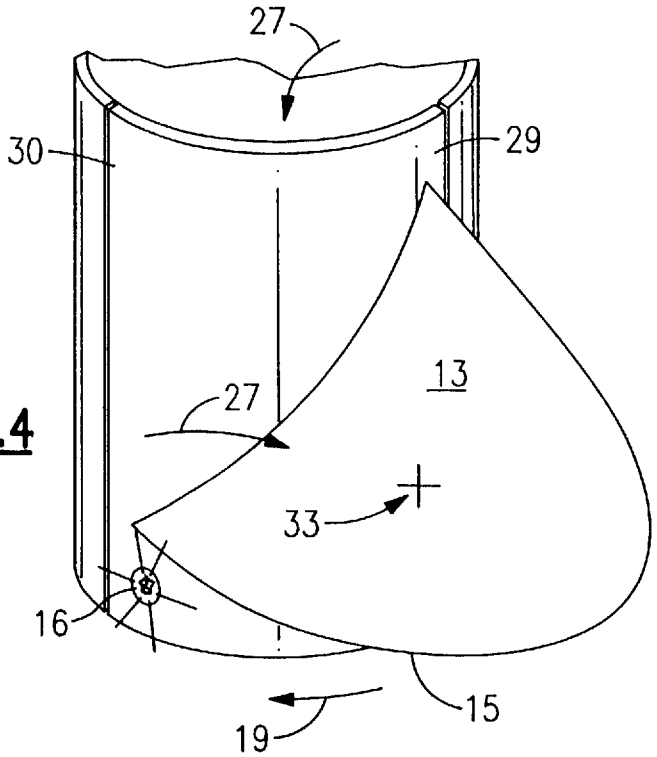
FIG. 4 is a diagrammatic view of one blade assembly, of the propeller of FIG. 1, showing the location of the center of fluid dynamic pressure on the blade to be aft of the blade assembly pivot point.

The movements of the blade assemblies are constrained by synchronizing arms (31), see FIGS. 1 and 6, which pivot about ball joint ends (25). These joints are secured to a stabilizing ring (32) which is freely rotatable on the central hub (11) about axis (10). This mechanism coordinates the simultaneous movement of the cylindrical segments (14) between their cylindrical, maximum pitch position and their minimum pitch position. As shown in FIG. 6, a biasing spring (34), attaching the stabilizing ring (32) and the central hub (11), biases the blade assembly in favor of its minimum pitch position until the blades (13) are subjected to a centrifugal force great enough to overcome the spring tension and the resistant force exerted by the fluid acting on the blades at the blade's center of fluid dynamic pressure (33).

This preferred embodiment of the present invention has many advantages, including the ability to vary the pitch of the propeller assembly by means of a balanced force support linkage placed substantially aft of the center of fluid dynamic pressure which coordinates and directs the movements of the blade assemblies, the ability to synchronize the movement of the blade assemblies such that they are each adjusted to the same pitch, and the ability to maintain the pitch even under variable loads when the center of fluid dynamic pressure fluctuates.

To summarize, this preferred embodiment balances the two competing forces acting on the blade assembly, centrifugal force and the fluid dynamic force, and adjusts the blade orientation accordingly. When centrifugal force eventually equals and then exceeds the force of water resistance as well as the force of the biasing spring (when present) the mechanism allows the blade assemblies to pivot about their pivots (16) away from the central hub forcing the blade assemblies from their minimum pitch, toward their maximum pitch, cylindrical position. As the centrifugal load on the blades decreases, the position of the blade assemblies is adjusted accordingly. Such changes occur automatically and require no additional input or mechanism to effect.

By placing the pivot (16) of each blade assembly adjacent to the leading edge of the blade (15) of that assembly, the location of the center of fluid dynamic pressure (33) is assured to remain aft of the associated pivot (16) throughout changes in the working angle of attachment of the blades. This effectively improves the performance of the propeller assembly under varying load conditions.

Further, by synchronizing and coordinating the simultaneous movement of the blade assembly, there is a reduced chance that the propeller assembly's rotation will become unbalanced due to a difference in the pitch of the blade assemblies. Such unbalanced rotation severely degrades performance of the propeller assembly.

Wherefore, I claim:

1. A self-adjusting variable pitch propeller having:

a support means defining a propeller rotation axis and a blade assembly supported by said support means for rotation thereby about said axis, said assembly comprising;

a) a blade;

b) a pivotal means pivotally securing said blade to said support means; and c) a control means connecting said blade to said support means, said control means being spaced from said pivotal means for adjustably controlling the pitch of said blade at least in part as a function of opposed hydrodynamic and centrifugal forces acting on the blade.

2. A propeller according to claim 1 wherein there are a plurality of blade assemblies supported by said support means, each by a pivotal means and by a said control means, and each control means is a control linkage pivotable to control both circumferential and radial movement of the associated blade about the associated pivotal means as a function of at least said opposed forces.

3. A self adjusting, variable pitch propeller comprising:

a central hub defining a propeller rotation axis;

a plurality of blade assemblies disposed about said hub, each assembly having a substantially cylindrical segment, said cylindrical segment having a leading and a trailing edge and a propeller blade fast to said cylindrical segment defining a leading blade edge;

a pivotal attachment pivotally securing each blade assembly to said hub; and control means interconnecting each assembly and said hub to permit controlled blade pitch adjustment to automatically occur, by allowing circumferential and radial movement of said assemblies relative to said axis, as a function of the magnitude of at least the opposed hydrodynamic and centrifugal forces acting on the assemblies.

4. A propeller according to claim 3 which defines a normal direction of rotation about said axis and said pivotal attachment circumferentially leads and is adjacent the leading blade edge of the associated blade at the junction of the blade with the cylindrical segment.

5. A propeller according to claim 3 wherein the propeller is automatically adjustable from a minimum to a maximum pitch and when at maximum pitch the cylindrical segments together form a substantially complete cylinder about the said axis.

6. A propeller according to claim 3 wherein each pivotal attachment is a ball joint defining a pivot center adjacent the associated segment.

7. A propeller according to claim 3 wherein the control means for each assembly comprises a first and second arms, both arms having a pivot joint at either end for pivotally attaching each said arm between the cylindrical segment of that assembly and said hub, said first arm being attached to said assembly adjacent the trailing edge and said second arm being attached closer to the leading edge.

8. A propeller according to claim 7 wherein there are three blade assemblies symmetrically disposed about said hub and said arms are pivotally attached to the hub at two adjacent of three axes extending parallel to the rotation axis and evenly spaced about the hub at the same radius from axis.

9. A propeller according to claim 8 wherein the three axes are circumferentially adjacent the leading edges and the radial axes of the ball joints.

10. A propeller according to claim 7 wherein the pivotal mounting of the first arm of an assembly and the second arm of the next assembly are, in each case, pivotally mounted to the same axis with the pivots on these axes.

11. A propeller according to claim 10 wherein all pivotal mountings of the arms are ball joints.

12. A propeller according to claim 7 wherein said pivot joints of both first and second arms of each assembly are parallel and of equal length.

13. A propeller according to claim 7 wherein when the centrifugal force exceeds the opposing forces the arms of each assembly pivot toward an orientation in which the second arm radially extend from the rotation axis so that the cylindrical segments, under control of the arms, define a substantially complete cylinder supporting the blades desirable for high speed operation.

14. A propeller according to claim 3 wherein the movements of the blade assemblies are constrained by synchronizing arms, which are pivotally secured to a stabilizing ring which is freely rotatable on the hub about the rotational axis to coordinate the simultaneous movement of the cylindrical segments between their cylindrical, maximum pitch position and their minimum pitch position.

15. A propeller according to claim 14 wherein a biasing spring, attaching the stabilizing ring and the central hub, biases the blade assembly in favor of said minimum pitch position until the blades are subjected to a centrifugal force great enough to overcome the spring tension and the hydrodynamic force.

16. A propeller according to claim 14 where, in the minimum pitch position, the trailing edge of said blade assembly extends from said axis at a greater radius than said leading edge, said trailing edge tending to pivotally orient itself at the same radius as said leading edge as the centrifugal force overcomes the opposed forces and the propeller attains maximum pitch.

* * * * *